United States Patent [19]

Anderson

[11] 4,389,824

[45] Jun. 28, 1983

[54] WINDOW AND DOOR TRIM FOR USE WITH SIDING

[76] Inventor: Carl Anderson, 2571 Richmond Terr., Staten Island, N.Y. 10303

[21] Appl. No.: 126,953

[22] Filed: Mar. 3, 1980

[51] Int. Cl.[3] ..... E06B 1/04

[52] U.S. Cl. ..... 52/211; 52/212; 52/287

[58] Field of Search ..... 52/211, 212, 213, 208, 52/273, 276, 278, 287, 288, 656

[56] References Cited

U.S. PATENT DOCUMENTS

| | | | |
|---|---|---|---|
| 855,696 | 6/1907 | Corbett | 52/211 |
| 908,858 | 1/1909 | Goddard | 49/505 |
| 2,826,282 | 3/1958 | Goldberg | 49/505 |
| 2,851,742 | 9/1958 | Johnston | 52/211 |
| 3,139,703 | 7/1964 | Hilt | 52/211 |
| 3,286,405 | 11/1966 | Schembri | 49/504 |
| 3,336,715 | 8/1967 | Savary | 52/656 |
| 3,500,600 | 3/1970 | Bagley | 52/211 |
| 3,788,019 | 1/1974 | Kiselewski | 52/217 |
| 3,826,050 | 7/1974 | Schwartz | 49/505 |
| 3,943,679 | 3/1976 | Dissinger | 49/505 |
| 4,193,238 | 3/1980 | Chalmers | 52/211 |
| 4,226,066 | 10/1980 | Persson | 49/504 |

FOREIGN PATENT DOCUMENTS

| | | | |
|---|---|---|---|
| 2422180 | 8/1974 | Fed. Rep. of Germany | 49/505 |

*Primary Examiner*—Price C. Faw, Jr.
*Assistant Examiner*—Henry E. Raduazo

[57] ABSTRACT

A window and door trim which can be used with siding placed against the walls of a house, and includes elongated L-shaped panels which fit around the casing. The shorter leg of the panels are disposable on the inside face of the casing with the longer legs of the panels being disposable on the front face of the casing and overlying the siding. In order to facilitate holding of the L-shaped panels, a facing strip can be attached to the inside face of the casing with the facing strip including a receiving slot for receiving and tightly holding the shorter leg of the panel. The distal edges of the longer leg of the panels can include a double folded over hem which provides a slight pressure against the siding. A method for applying the window and door trim is described.

18 Claims, 9 Drawing Figures

WINDOW AND DOOR TRIM FOR USE WITH SIDING

BACKGROUND OF THE INVENTION

This invention relates to accessories for use with siding placed on a house, and more specifically to a window and door trim as well as sill covers which can be used in conjunction with the siding.

The use of siding for protecting the outside of a house is becoming more prevalent. Such siding is generally made of aluminum or more recently of vinyl material and is attached along the outside face of a house. In order to complete the exterior covering of the house, the various types of accessory moldings are needed. For example, various types of moldings are needed at the corners, edges, adjacent the roof, and at various other interconnecting locations.

Typically, when finishing off a window or door, the usual J channel is utilized. Such J channels are conventional in the art and have been utilized for almost all exterior siding. The J channel is first attached around the window frame with one leg of the channel being fastened directly to the frame. The J channel then forms a pocket for receiving the ends of the siding therein.

Although such J channels have been utilized in the past, they have presented some problems in connection with maintenance of the siding as well as providing suitable protection for the house. Since one leg of the J channel is located beneath the siding, as the rain slides along the outer face of the siding adjacent to a window or door, there is a tendency for the rain to flow along the J channel and thereby reach behind the siding. Such continued rain and moisture may deteriorate the wood of the frame and surrounding area. It may also be able to flow into the insulating material and cause the insulating material to become filled with water. The water may be retained in the insulating material and may cause additional moisture damage to the house itself.

In addition, the use of the J channel has provided continuous problems to installers, who must first place the J channel around the frames and subsequently interfit the siding within the J channel. Such procedures place constraints upon the installers and add increased difficulty as well as cost and time for installation.

Furthermore, many individuals find the window trim with a J channel most unaesthetic. Where the window frame is not smooth, the J channel may not provide a smooth connection to the frame and accordingly bumps, dislocations, and open spaces may occur around windows and door. Also, when using the J channel there is no protection to the actual window casing itself which requires separate finishing material or paint.

SUMMARY OF THE INVENTION

Accordingly, it is an object of the present invention to provide an improved window and door trim which avoids the aforementioned problems of prior art devices.

Still another object of the present invention is to provide a window and door trim for use with siding being placed on a housing, wherein the trim is placed after the siding has been secured to the house.

A further object of the present invention is to provide a window and door trim which protects the window casing as well as the window frame.

Still another object of the present invention is to provide a window and door trim which avoids the problem of having part of the trim behind the siding.

Yet a further object of the present invention is to provide a window and door trim which fits over adjacent siding being placed on the housing.

Another object of the present invention is to provide a window and door trim which utilizes uniform panels which can be cut and fit in situ so as to accommodate the size and shape of various windows and doors.

Still another object of the present invention is to provide a window and door trim which is easy to install, provides aesthetic beauty, is long lasting, and provides maintenance free use.

A further object of the present invention is to provide a window and door trim which utilizes preformed panels having a double folded over hem which panels can be folded into an L-shaped configuration in situ for fitting against the casing of a window or door.

Yet another object of the present invention is to provide a window and door trim which includes a facing strip having a double folded over edge forming a receiving slot, and an L-shaped panel also having a double folded over edge, one leg of the panel fitting into the receiving slot with the double folded over edge of the panel abutting against the siding.

Another object of the present invention is to provide a sill cover for use in conjunction with a window and door trim for providing a complete interfitting arrangement for finishing a window.

A further object of the present invention is to provide a method for applying a window and door trim to a house being covered with siding.

Briefly, in accordance with the present invention there is provided a window and door trim for use with siding. The trim includes an elongated L-shaped panel which fits around the casing of the window or door. The shorter leg of the panel is disposable on the inside face of the casing while the longer leg is disposable on the front face of the casing and overlying the siding.

In accordance with an embodiment of the invention, there is also provided a facing strip for attachment to the inside face of a casing. The facing strip includes a receiving slot for receiving the shorter leg of the panel and retaining it.

The receiving slot of the facing strip can be formed by means of a hem, such as a double folded edge, which is tightly retained against the side wall. Similarly, a hem, such as a double folded edge, can also be formed at the distal edge of the longer leg of the panel so as to abut against the siding. A lower sill covering is also provided which can be utilized with the trim and interfits therewith to provide a complete finished window.

The present invention also provides for a method for trimming a window or door casing of the house being covered with siding. The method includes placing the siding against the house with the ends of the siding terminating approximately adjacent the casing. A substantially flat panel is bent in situ into an L-shaped configuration. The L-shaped panel is then fit around the casing with the shorter leg of the panel being disposed on the inside face of the casing and the longer leg of the panel being disposed on the front face of the casing and overlying the siding.

The aforementioned objects and features of the invention will, in part, be pointed out in more detail and will be described in more particulars in the following detailed description of the invention, taken in conjunction with the accompanying drawings which form an integral part thereof.

BRIEF DESCRIPTION OF THE DRAWINGS

In the drawings.

In the various figures of the drawings, like reference characters designate like parts.

DETAILED DESCRIPTION OF THE INVENTION

Figure 1:
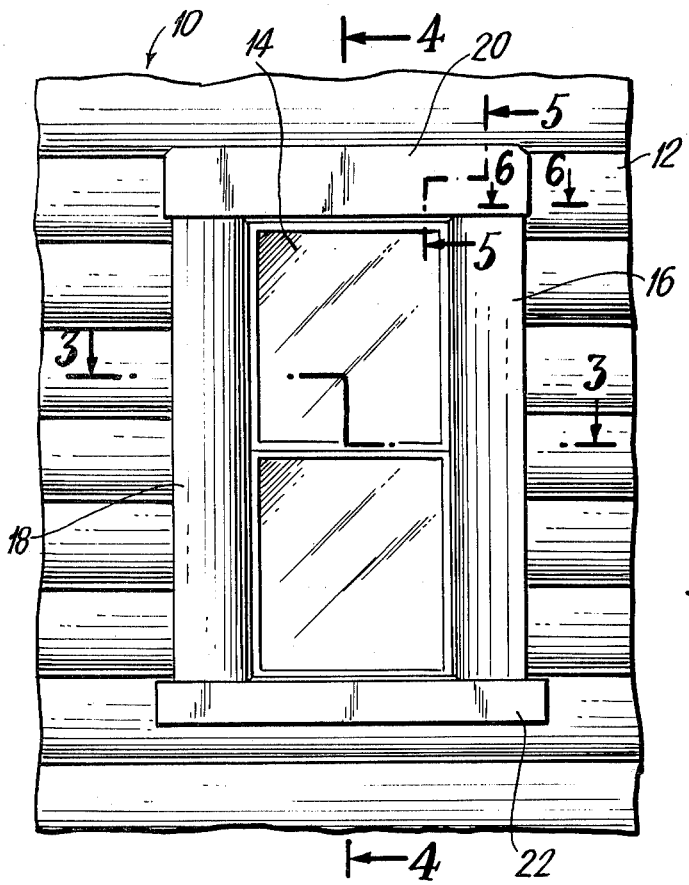
FIG. 1 is a front elevational view of a window of a house and including the trim, in accordance with the present invention.

Referring now to FIG. 1 there is shown a section of a housing 10 on which there has been placed panels of siding 12. Such panels can be of aluminum, vinyl, or such similar material as is commonly used in the art. There is also shown a window 14 which has been trimmed with a suitable window trim in accordance with the present invention. It should be understood that a similar type of trim would be utilized in conjunction with a door molding. The trim includes the side panels 16, 18 which interfit with an upper panel 20 as well as with a windowsill 22. Although a separate windowsill 22 is shown, it is understood that the upper panel 20 could be also utilized to cover the lower sill portion.

Figure 2:
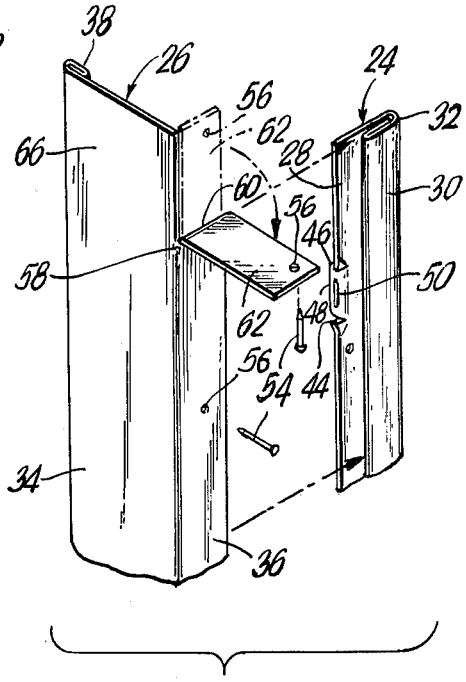
FIG. 2 is a perspective view of two sections forming the trim, in accordance with an embodiment of the present invention.
Figure 3:
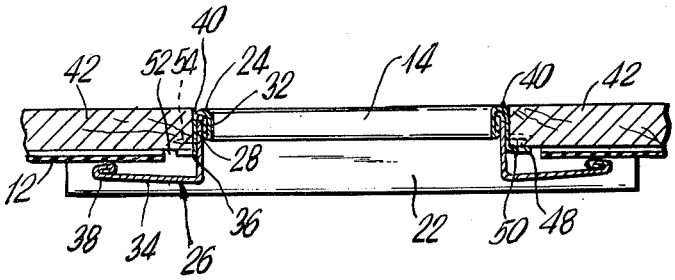
FIG. 3 is a cross sectional view taken along lines 3—3 of FIG. 1, and showing a sectional plan view of the trim.
Figure 4:
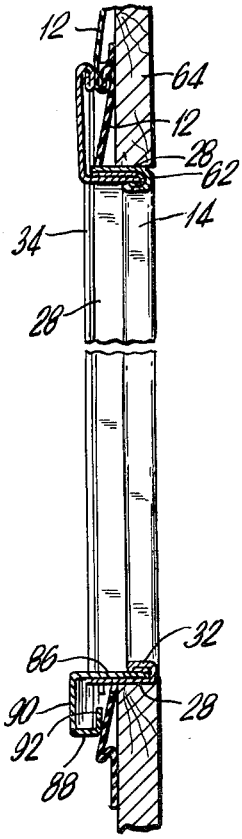
FIG. 4 is a sectional view taken along lines 4—4 of FIG. 1 and showing a sectional elevational view.

As can best be seen in FIGS. 2, 3 and 4, the side trim is comprised of a first section which serves as a facing strip 24 and a second section which is the L-shaped panel 26. The facing strip includes a side wall 28 having a hem 30 formed at one edge thereof. The hem 30 is shown as being a double folded over section 32 which is tightly retained against the side wall 28. The L-shaped section 26 includes a longer leg 34 and a shorter leg 36 approximately perpendicular thereto. At the distal edge of the longer leg 34 there is also provided a hem 38 and is shown as also being a double folded over edge.

The side panels are installed as follows: Initially, the facing strips 24 are attached to the inside face 40 of the side casings 42. The side walls 28 of the facing strips are short and can therefore be utilized with all types of window casings. If the side face of the casing is very wide, then the facing strips 24 will only cover a portion thereof. However, they can be easily fitted against the side facing of almost any sized window or door casing.

The facing strips are secured against the side face of the casing by means of any suitable fastening means. However, one convenient method of fastening such facing strips can best be described in connection with FIGS. 2 and 3. Spaced apart slots 44, 46, are cut into the outer edge of the side wall 28 of the facing strip and the portion therebetween 48 is struck so as to lie in a substantially forward direction so that it can overlie the front face of the side casing 42. Using a staple gun, staples 50 can then be placed in these forward facing tabular sections 48 in order to secure the facing strips along the casing.

With the facing strip in place, the L-shaped panels can now be positioned. Initially, the panels are provided in flat sheets. They can be bent into an L-shaped configuration in situ by using a bending brake. However, the hems 38 can be pre-provided on the panels. They can also be provided on the facing strips. Such double folded over edges can be formed by means of a bending operation or alternately the sections can be extruded with the hems already formed.

By bending the panels in situ a suitable bend can be provided to accommodate different casing sizes. In this way, the legs of the L-shaped panel can be formed so as to suitable fit on the inside face of the casing and overlie the front face of the casing as well as the adjacent siding.

As can best be seen in FIG. 3, the L-shaped panel has its shorter leg 36 inserted into the space between the double folded over edge 32 and the side wall 28 of the facing strip. This space therebetween forms a receiving slot for such shorter leg. The longer leg 34 with the hem 38 overlies the front face 52 of the casing 42 as well as the adjacent siding panels 12. Fasteners, such as nails 54 can be placed at suitable positions through preformed receiving holes 56 in order to anchor the side panels in place.

In installing the side panels after the facing strips have been connected on the inside face of the casing, the L-shaped panels are then cut a suitable length so that the lower end reaches from the bottom of the casing, extends the length of the side casing, and extends across the upper casing and onto the upper siding. The upper end of the side of the panel is then cut along the bend as shown in FIG. 2 until a point 58 so that the length of the uncut shorter leg proximates the height of the inside face of the side casing. The shorter leg is then bent along the line 60 which continues from the cut point 58 to form the bent leg 62. The longer leg, however, continues to extend laterally upward from the bent leg.

Figure 5:
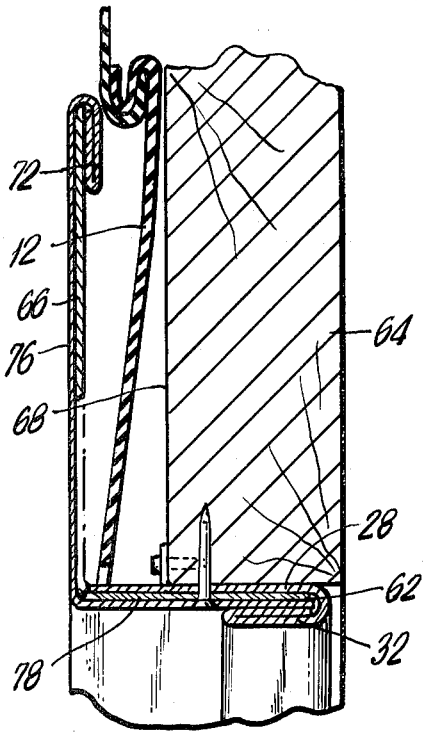
FIG. 5 is a sectional view taken along line 5—5 of FIG. 1 and showing a detailed sectional elevational view of the placement of the upper panel.

The side panel is then installed with the vertical section of the shorter leg being inserted in the receiving slot of the facing strip already installed against the inside face of the casing. The bent leg is bent over so as to be received in the receiving slot of the facing strip positioned against the inside face of the upper casing 64 as shown in FIG. 5. The upper end 66 of the longer legs will continue upward so as to extend on the front face 68 of the upper casing 64 and continue over the siding 12.

Figure 9:
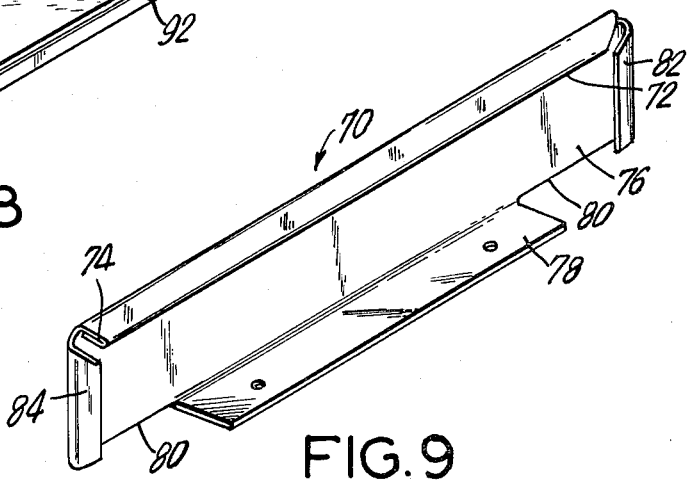
FIG. 9 is a perspective view of the upper panel in accordance with the present invention.

Referring now to FIG. 9, the upper panel 70 will now be described. Such panel is also initially formed of the same panel material having a substantially flat shape with a hem portion 72. Again, the hem portion is shown as being a double folded over hem 74. The panel is bent into an L-shaped configuration, in situ, so as to include the longer leg 76, and the shorter leg 78. The length of the various legs are such as to accommodate the size of the casing.

The length of the upper panel is such as to not only extend across the upper casing, but continue to laterally cover the side panels and overlap such panels. Accordingly, after the upper panel has been cut to a suitable length and shaped into its L-shaped configuration, both ends are cut along the bend, the distance 80 from either side, so that the remaining length of the shorter leg 78 proximates the distance between the side panels.

Figure 6:
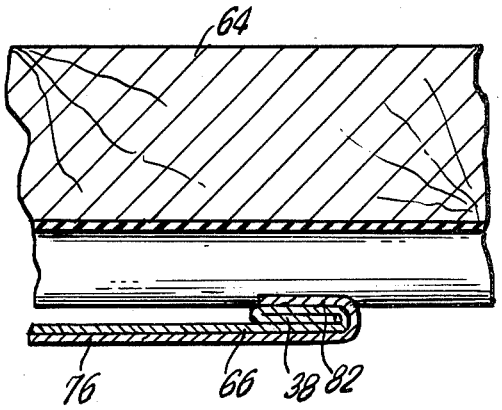
FIG. 6 is a sectional view taken along line 6—6 of FIG. 1 and showing the interconnection between the upper panel and the side panel.

As can best be seen in FIGS. 4 and 5, the upper panel 70 is inserted at the upper casing with its shorter leg 78 inserted into the receiving slot formed by the facing strip fastened to the inside face of the upper casing. In those locations where the bent leg 62 from the side panels is present, as shown in FIG. 5, the shorter leg 78 can be placed beneath such bent legs. The longer leg 76 will cover the side panels. The double folded over edge 72 at the distal end of the longer leg is hooked over the upper edge of the side panels 66 so as to form an aesthetically smooth edge and at the same time provide an interlocking arrangement. Similarly, the two lateral edges are folded over at 82, 84, as shown in FIG. 9. Such folds are formed after the upper panel is in place so that it will also fold over the hems 38 of the side panels and thereby also provide an interlocking relationships, as shown in FIG. 6.

In the aforedescribed manner, the window can be trimmed with side panels, and an upper panel. The panels overlie the siding and are attached in place after the siding has already been installed. The window trim accordingly does not lie beneath the panels but overlies the siding panels. As a result, rain falling along the surface of the siding will not have a chance to flow beneath the panels, as existed in connection with using the J-channels of the prior art. On the contrary, the flow of water will be on the outer surface of the trim and therefore will continue to flow on the exterior of the house.

By making the double folded over edge, rigidity is provided to the outer edge of the window trim. At the same time the hem will provide a slight pressure against the siding so as to retain the window trim securely against the siding. Such slight pressure can be increased by making the bend between the legs of the L-shaped member slightly less than 90°. As a result, the hems will form a spring like pressure against the siding to prevent the lifting up of the window trim from the siding.

Figure 7:
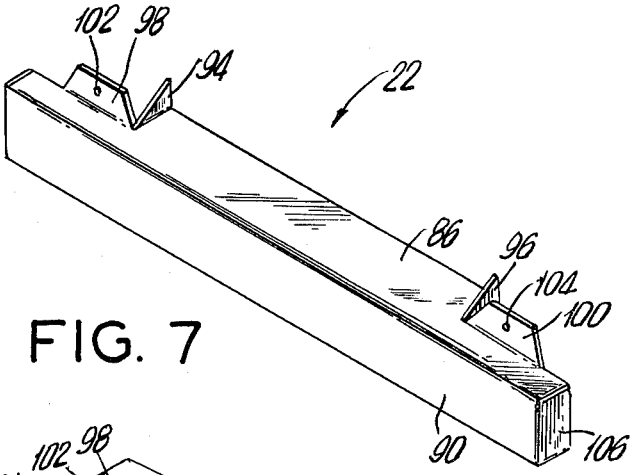
FIG. 7 is a perspective view of the outside of the sill covering, in accordance with an embodiment of the present invention.
Figure 8:
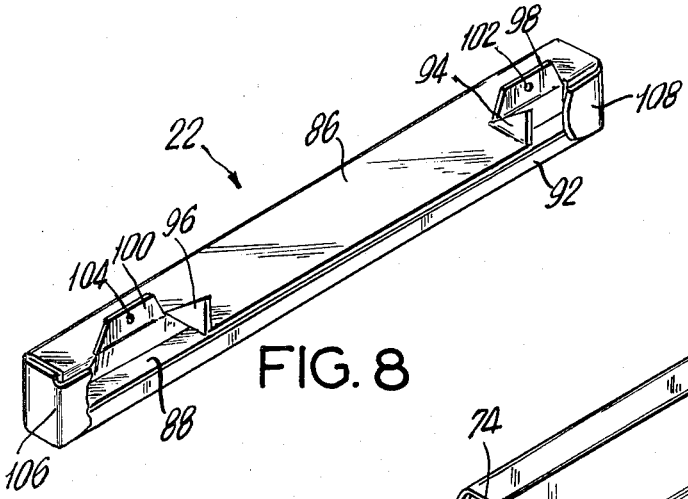
FIG. 8 is a perspective view showing the inside of the sill covering of FIG. 7.

Although the same type of window treatment which was applied at the upper casing could also be applied at the lower casing, additionally, a separate windowsill covering 22 can be utilized. With reference now to FIGS. 7 and 8, it will be seen that the sill covering 22 is an elongated member having a substantially U-shaped configuration including a longer leg 86 and a shorter leg 88 interconnected by a bight section 90. An upwardly turned lip 92 extends from the distal edge of the shorter leg 88. At a distance from either end of the longer leg, the longer leg 86 is cut at an angle so as to form the upwardly turned locating fingers 94, 96, which are triangular in shape. Simultaneous with the formation of the fingers there are formed the upwardly turned tabular sections 98, 100 which are trapezoidal in shape. The fingers 96, 94, are spaced apart a distance proximating the distance between the side panels. The tabular sections 98, 100 are positioned so as to face against the side casing. Openings 102, 104 are formed for receiving therethrough fastening means to maintain the sill covering in place.

The sill covering extends a distance greater than the width of the window casing so as to completely cover the sill and extend slightly past the side panels 16, 18. Both ends of the sill covering are closed off. Such closures can be formed by means of separately formed end caps or, alternately, can be formed by cutting and folding the ends to form the integral closures 106, 108. Such closures can be formed similar to the closures at the end of a box or other such container.

When installing the sill covering, as shown in FIG. 4, the leg 86 is inserted into the receiving slot of the facing strip 28 which has been attached against the inside face of the lower casing. The upwardly extending locating fingers 94, 96 will be placed in the receiving slots of the facing strips of the side casing and the upwardly extending tabs 98, 100 will abut against the front face of the side casing to receive fastening means therein to secure the window sill in position.

In assembling the window trim, initially the lower sill portion is installed. Then, the two side panels are cut and installed. The lower ends of the side panels would be on top of the longer leg 86 of the sill covering. After the side panels are in place, the upper panel would be connected.

The result of utilizing the present window trim arrangement is that a suitable aesthetic window covering is achieved without the detriments of utilizing the J-channel as in the prior art. It further provides a finished look which will not need continued maintenance and also avoids the possibility of having water flowing behind the siding.

In order to further facilitate the removal of water from the window area, the lower sill covering can be formed with the upper leg having an angle slightly greater than 90° with respect to the bight portion. As a result, when the water flows down the siding and onto the side panels, the water will flow down the side panels reaching the upper leg of the sill covering. Since this is slightly angled with respect to the bight portion, the water will flow off the sill covering either along its front or along the lateral sides thereof.

In addition to utilizing the sill covering as described, the lower casing could be covered with an arrangement similar to that described with regard to the upper casing. Additionally, although a window trim arrangement was described, it is understood that a similar arrangement could be utilized with regard to a door trim.

One of the concepts of the present invention is that the panels forming the window and door trim fit over the siding rather than under it. Accordingly, a simplified version of the present invention could include a simple L-shaped panel with the short leg attached directly to the casing and the longer leg fitting over the side casings and the adjacent siding. The use of the facing strips as well as the use of the double folded over hem provides improvements over the basic concept, however, the basic concept of a simple L-shaped panel is included. A similar such L-shaped panel could also be utilized for the upper and lower casings.

Additionally, although a double folded over edge was described, it is understood that a simple single fold, or for that matter, more than a double fold arrangement could also be utilized. The material of the window sill could be either of aluminum, vinyl, or other materials from which such trims can conventionally be made. It should further be pointed out, that the panels can be sold as long sheets which can be cut to size and bent in situ to fit the particular sized windows and doors. Accordingly, standard panels can be readily manufactured. Such panels can include the double folded over edge pre-formed.

There has been described heretofore the best embodiments of the present invention presently contemplated. However, it is understood that modifications of the present invention can be made and are included within the scope of the invention.

I claim:

1. A window and door trim for use with siding, comprising:

elongated, L-shaped panels having one longer and one short leg interconnected by an angle less than 90°, for fitting around a casing having a front and an inside face, coupling means associated with said shorter leg for coupling of the shorter leg onto the inside face of the casing, said longer leg terminating in a free distal end having an inwardly turned, double folded over panel hem tightly retained against said longer leg to form a triple thickness of material at the distal end, the combination of the less than 90° interconnection with the double folded over hem providing for spring held abutment of the longer leg against the siding without the use of any fastening members, and wherein the shorter leg is disposable on the inside face of the casing and the longer leg is disposable in a substantially vertical plane on the front face of the casing and entirely overlying the siding without any portion of the panel lying under the siding, wherein the casing has sections including a side casing and upper casing, and wherein two of said panels form side panels for fitting onto the side casing, the longer legs of said side panels extending across the upper casing and onto the siding, and wherein one of said panels forms an upper panel for fitting onto the upper casing and overlapping said side panels.

2. A window and door trim as in claim 1, and further comprising a facing strip for attachment to the inside face of the casing, and including an integrally formed spring held receiving slot for receiving therein the shorter leg of said panel and constituting said coupling means.

3. A window and door trim as in claim 2, wherein said facing strip comprises a side wall for abutting against the inside face of the casing, and a forwardly turned strip hem, said receiving slot being defined between said side wall and said hem.

4. A window and door trim as in claim 3, wherein said strip hem comprises a double folded edge whereby the shorter leg of said panel is spring held in said receiving slot.

5. A window and door trim as in claim 3, wherein said side wall comprises a forward edge, and further comprising laterally extending tabular sections struck from the forward edge of the side walls of said facing strips for overlying the front face of the casing to receive fastening means for securing said facing strips to the casing.

6. A window and door trim as in claim 5, wherein said fastening means comprises staples.

7. A window and door trim as in claim 1, and further comprising a facing strip for attachment to the inside facing of the casing, and including a spring held receiving slot for receiving therein the shorter leg of said panels and constituting said coupling means.

8. A window and door trim as in claim 1, wherein the shorter leg of the side panels are bent to be disposed on the inside face of the upper casing.

9. A window and door trim as in claim 1, wherein the longer leg of each panel has lateral ends, the panel hem on said upper panel locking onto a lateral end of each of the longer legs of the side panels, said upper panels further including folded edges along the lateral ends of the longer leg thereof for locking onto the free distal ends of the longer legs of the side panels.

10. A window and door trim as in claim 9, wherein the shorter leg of the upper panel which is disposed on the inside face of the upper casing extends between the inside faces of the side casing, and the longer leg of the upper panel continues laterally of the shorter leg to extend across the side panels.

11. A window and door trim as in claim 1, and further comprising fastening means for securing said panels to said casing at spaced apart locations along the panels said fastening means constituting said coupling means.

12. A window and door trim as in claim 1, wherein the casing includes a lower sill and wherein the lower ends of the side panels terminate at the sill.

13. A window and door trim as in claim 1, wherein the casing includes a lower sill and further comprising a lower sill covering for matingly interfitting with said panels.

14. A window and door trim as in claim 13, wherein said sill covering comprises an elongated substantially U-shaped member, one of the legs of which is shorter than the other, and an upturned lip extending from the edge of the shorter leg.

15. A window and door trim as in claim 14, wherein said longer leg is cut to form upwardly extending locating fingers for fitting against the inside face of the side casings, and upwardly extending fastening tabs for fitting against the front face of the side casings, and being disposable under the panels.

16. A window and door trim as in claim 14, and further comprising end closure means for closing the lateral ends of said U-shaped sill cover.

17. A window and door trim as in claim 16, wherein said end closure means is formed by folding the end corners of the U-shaped sill cover to form integral end caps.

18. A window and door trim as in claim 14, wherein the longer leg of said sill covering forms an angle slightly greater than 90° with the bight portion of the sill covering.

* * * * *